United States Patent [19]

Langen

[11] Patent Number: 4,721,262

[45] Date of Patent: Jan. 26, 1988

[54] TEXTILE MACHINE FOR PRODUCING CROSS-WOUND BOBBINS

[75] Inventor: Manfred Langen, Moenchengladbach, Fed. Rep. of Germany

[73] Assignee: W. Schlafhorst & Co., Moenchengladbach, Fed. Rep. of Germany

[21] Appl. No.: 61,603

[22] Filed: Jun. 19, 1987

Related U.S. Application Data

[63] Continuation of Ser. No. 844,814, Mar. 27, 1986, abandoned.

[30] Foreign Application Priority Data

Mar. 30, 1985 [DE] Fed. Rep. of Germany ..... 3511816

[51] Int. Cl.[4] ..... B65H 67/06

[52] U.S. Cl. ..... 242/35.5 A; 414/331; 414/591

[58] Field of Search ..... 242/35.5 A, 35.5 R, 242/79, 35.6 R; 198/465.4, 680; 414/591, 626, 564, 331

[56] References Cited

U.S. PATENT DOCUMENTS

| | | | |
|---|---|---|---|
| 3,141,560 | 7/1964 | Rink | 414/564 |
| 3,682,331 | 8/1972 | Fetherston | 414/331 |
| 3,696,949 | 10/1972 | Leblond et al. | 414/331 |
| 3,906,712 | 9/1975 | Miyazaki et al. | 242/35.5 A X |
| 3,945,505 | 3/1976 | Frisbie et al. | 414/331 |
| 4,277,216 | 7/1981 | Lindberg | 414/331 |
| 4,368,001 | 1/1983 | Carraroli | 414/331 |
| 4,396,335 | 8/1983 | Brandstetter et al. | 242/35.5 A X |
| 4,555,215 | 11/1985 | Raasch et al. | 242/35.5 A X |
| 4,565,278 | 1/1986 | Asai et al. | 242/35.5 A X |

*Primary Examiner*—Stanley N. Gilreath

*Attorney, Agent, or Firm*—Herbert L. Lerner; Laurence A. Greenberg

[57] ABSTRACT

A textile machine for producing cross-wound bobbins includes a head end of the textile machine, a cycling conveyor disposed at the head end for transporting cross-wound bobbins in a given cycling direction, at least one bobbin frame accepting at least one cross-wound bobbin from the cycling conveyor, a device for moving the bobbin frame across the given cycling direction, the bobbin frame including at least one pair of mutually spaced apart carrier elements for supporting at least one row of cross-wound bobbins at least at one level, the carrier elements of each pair being disposed at substantially the same height above the cycling conveyor and being mutually spaced apart by a given distance, the cycling conveyor being narrower than the given distance, the bobbin frame having vertical openings formed therein permitting passage of the cycling conveyor, and at least one lifting device for adjusting the height of the bobbin frame relative to the cycling conveyor.

13 Claims, 15 Drawing Figures

TEXTILE MACHINE FOR PRODUCING CROSS-WOUND BOBBINS

This application is a continuation of application Ser. No. 844,814, filed Mar. 27, 1986, now abandoned.

The invention relates to a textile machine for producing cross-wound bobbins, including a cycling conveyor at the head end of the textile machine for the finished cross-wound bobbins being horizontal or somewhat inclined from the horizontal, a movable bobbin frame for accepting the cross-wound bobbins from the cycling conveyor, and carrier elements being horizontal or slightly forwardly inclined relative to the horizontal for rows of cross-wound bobbins disposed at least at one level.

According to the present state of the art, cross-wound bobbins which are sequentially supplied by the cycling conveyor are picked up by a gripping device, turned, and then individually and sequentially placed onto carrying elements of the bobbin frame.

Regardless of the fact that this bobbin transfer is rather slow, the process is also rather rough and sometimes damaging to the cross-wound bobbins.

It is accordingly an object of the invention to provide a textile machine for producing cross-wound bobbins, which overcomes the hereinafore-mentioned disadvantages of the heretofore-known devices of this general type, and to create conditions in which the cross-wound bobbins can be transferred to the bobbin frame automatically and in a manner which is rapid and at the same time is not rough on the bobbins.

With the foregoing and other objects in view there is provided, in accordance with the invention, a textile machine for producing cross-wound bobbins or cheeses, comprising a head end of the textile machine, a cycling transporter or conveyor disposed at the head end for transporting cross-wound bobbins in a given cycling direction, the conveyor being horizontal or slightly inclined from the horizontal, at least one bobbin frame accepting at least one cross-wound bobbin from the cycling conveyor, means for moving the bobbin frame across or at a right angle to the given cycling direction, the bobbin frame including at least one pair of mutually spaced apart carrier elements for supporting at least one row of cross-wound bobbins at least at one level or tier, the carrier elements of each pair being disposed at substantially the same height above the cycling conveyor and being mutually spaced apart by a given distance and the carrier elements being horizontal or slightly forwardly inclined from the horizontal, the cycling conveyor being narrower than the given distance, the bobbin frame having vertical openings formed therein permitting passage of the cycling conveyor, and at least one lifting device for adjusting the height of the bobbin frame relative to the cycling conveyor.

After one bobbin frame has been filled with bobbins, the next frame can be moved in place and filled. The bobbin frame therefore serves as an intermediate bobbin magazine. The bobbin frame can travel directly to the device required for the further processing of the bobbins and can be unloaded there with a cycling conveyor, by a reversed sequence of the procedure.

The filling of the bobbin frame is advantageously performed vertically, row by row. As seen in the travel direction, the first row is initially loaded, beginning with the upper tier or level. The loading is carried out fully automatically, as will be explained below.

In accordance with another feature of the invention, there are provided means for operating the lifting device in a controlled cycle. The lifting distance therefore corresponds to the distance between the levels.

In accordance with a further feature of the invention, the lifting device is connected to the cycling conveyor. This is a simpler construction of the bobbin frame because the bobbin frame advances with the same rhythm.

In accordance with an added feature of the invention, the lifting device is connected to the bobbin frame. This is also advantageous because in this case the cycling conveyor can remain in a fixed connection with the textile machine, which produces the cross-wound bobbins, and no space is required for a height adjustment.

In accordance with an additional feature of the invention, there is provided a common cycle control device connected to the bobbin frame, the cycling conveyor and the lifting device. This is a prerequisite for the fully automatic operation.

In accordance with again another feature of the invention, the carrier elements support a plurality of rows of bobbins at respective levels including a top level, and the bobbin frame is formed of a frame structure including vertical carriers carrying the carrier elements, and at least one cross member interconnecting the vertical carriers above the top level. The cycling conveyor can pass between the vertical carriers, so that no special structural requirements are needed. A simple conveyor with cycling provisions is sufficient.

In accordance with again a further feature of the invention, the bobbin frame is a hanging carriage. This embodiment makes use of the fact that the hanging carriage can travel above the head of operating personnel, so that the servicing passages remain clear.

In accordance with again an added feature of the invention, the bobbin frame moving means includes a drive mechanism, and the lifting device is disposed between the drive mechanism and the frame structure. The lifting device only lowers the bobbin frame during the loading operation. During its travel, the frame is raised, so that a lifting device which is in connection with a hanging carriage is quite practical.

If a stationary device is chosen, it is of advantage if, in accordance with again an additional feature of the invention, the lifting device is disposed below the cycling conveyor. Such a construction requires little space and the loads to be lifted are advantageously distributed.

In accordance with a concomitant feature of the invention, the bobbins on the carrier elements are disposed in vertical rows spaced apart by a given spacing, and the drive mechanism moves the bobbin frame by a cycling travel distance substantially equal to the given spacing. In this case, the loading cycle can progress from bobbin row to bobbin row and later the unloading can proceed in the same cyclic rhythm.

Other features which are considered as characteristic for the invention are set forth in the appended claims.

Although the invention is illustrated and described herein as embodied in a textile machine for producing cross-wound bobbins, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
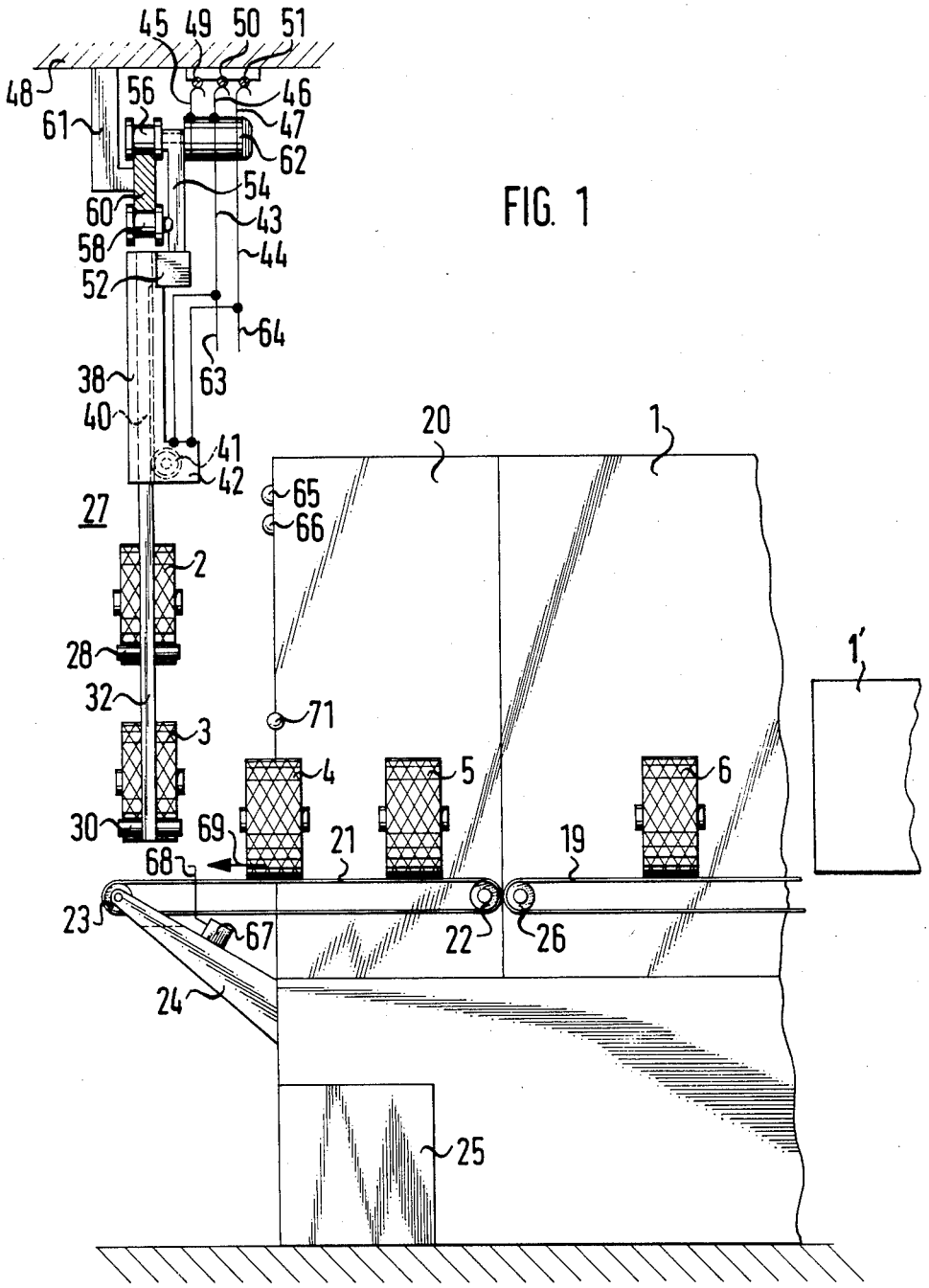
FIG. 1 is a fragmentary, diagrammatic, front-elevational view of the textile machine according to the invention.

Referring now to the drawings in detail and first, particularly, to the embodiment according to FIGS. 1 to 7 thereof, there is seen a textile machine which produces cross-wound bobbins or cheeses that is designated as a whole with reference numeral 1. The finished cross-wound bobbins, such as a bobbin 6, which are produced by the textile machine 1 according to FIG. 1, are transported by a belt or band conveyor 19 from a winding machine 1' to a head end 20 of the textile machine 1, and are transferred to a cycling conveyor or transporter 21 at the head of the machine. The cycling conveyor 21 is horizontal in this case and is constructed in the form of an endless conveyor belt which runs over belt rollers 22 and 23. The belt roller 23 is disposed at the end of a bracket 24. The belt roller 22 is integrated with an electric belt roller motor, which is functionally or operatively connected to a central cycle control device 25.

An electric belt roller motor which is also integrated in a belt roller 26 of the conveyor belt 19, is also functionally connected to the cycle control device 25.

A bobbin frame or creel 27 is disposed above the cycling conveyor 21. The bobbin frame 27 is constructed as a hanging carriage, with a frame structure which supports carrying elements 28, 29 and 30, 31, respectively, which are disposed in pairs. The frame structure is formed of vertical carriers 32 to 36 which are connected with each other at the upper end by a cross member 37.

Figure 2:
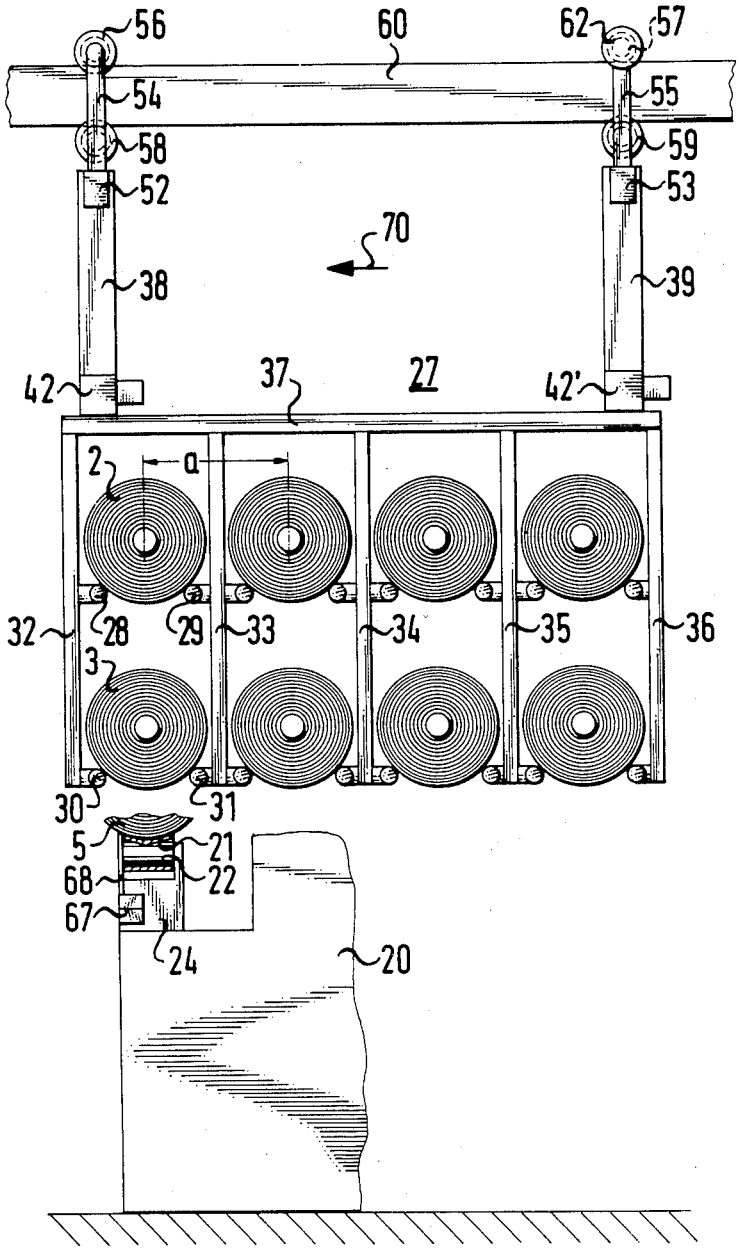
FIG. 2 is a side-elevational view of the bobbin frame of the textile machine.

According to FIG. 2, there are provided two carrying elements 28, 29 or 30, 31, which are spaced from each other and positioned approximately at the same height, for each respective crosswound bobbin 2 or 3 contained in the bobbin frame 27. FIG. 2 shows that the cycling conveyor 21, including its bracket 24, is narrower than the distance between the two carrying elements 28, 29 or 30, 31, of a respective cross-wound bobbin 2 or 3.

Two lifting or elevating devices 38 and 39 are connected to the bobbin frame 27. The two lifting devices are similarly constructed. For example, the lifting device 38 according to FIG. 1 is provided with a vertical toothed rack 40, which is fastened to the cross member 37 and engages a gear 41, which is part of a drive motor 42. The drive motor 42 is connected by lines 43, 44 with current collector bows or overhead collectors 46, 47, which are in contact with current rails 50, 51, that are disposed below the ceiling 48 of the machine room.

The upper end of the housing of the lifting device 38 has a bearing support 52 for a carrier rod 54; and the upper end of the housing of lifting device 39 has a similar bearing support 53 for a carrier rod 55. A travelling roller 56 is disposed at the top of the carrier rod 54, and a guide roller 58 is rotatably supported at the bottom. The two rollers embrace a rail 60, which is suspended from the ceiling 48 of the machine room on brackets 61.

The carrier rod 55 carries a drive motor 62 at its upper end, which contacts the electric current rails 49 and 50 through the current collector bows or overhead collectors 45 and 46. A roller 57 which is mounted on the shaft of the drive motor 62 sits on the rail 60.

Below the roller 57 and the drive motor 62, the carrier rod 55 has a guide roller 59 which contacts the rail 60 from the bottom. All of the rollers are constructed as flanged wheels.

Lines 63 and 64 form a parallel electric circuit between the drive motor 42 of the lifting device 38 and a drive motor 42' of the lifting device 39.

Two reflecting light barriers or gates 65 and 66 are disposed at the head end 20 of the textile machine 1. Both reflecting light barriers are connected to the cycle control device 25. The optical axis of the reflecting light barrier 65 is oriented in such a way that it hits the vertical carrier 32, if the bobbin frame 27 is positioned as shown in FIG. 2. The optical axis of reflecting light barrier 66 is aligned in such a way that it hits the vertical carrier 33, if the bobbin frame 27 is in the same position.

According to FIGS. 1 and 2, the bracket 24 supports a microswitch 67 which is functionally connected to the cycle control device 25. An actuator arm 68 of the microswitch 67 is disposed at the side of the cycling conveyor 21 and is raised above the upper edge of the cycling conveyor 21, so that the actuator arm 68 is pressed down, for example, by a cross-wound bobbin 4 if this bobbin is transported in a direction 69 after the belt roller 22 has been set in motion. The actuator arm is only released again after the bobbin 4 is in the same position as that of the bobbin 2 in FIG. 5. After the actuator arm 68 of the microswitch 67 is released, the microswitch 67 switches back to its original state.

Figure 3:
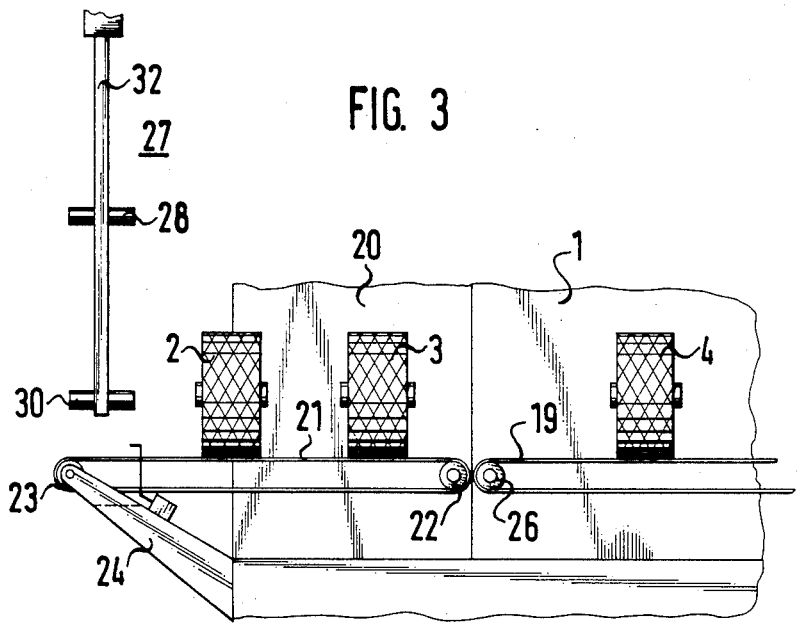
FIGS. 3 to 7 are front-elevational views of a portion of FIG. 1 shown in various operating phases.

The cycle control device 25 contains a timer which triggers certain functions in a time sequence, which stops between cycles to receive a start-command, then initiates additional activities, then stops again to receive an additional start command, and then again initiates a sequence of predetermined activities. This subject will be further explained below:

Before the bobbin frame 27 which is moving in the direction 70 seen in FIG. 2 has arrived above the cycling conveyor 21, two cross-wound bobbins 2 and 3 are already on the conveyor 21, as shown in FIG. 3. At the moment when the optical axis of the reflecting light barrier 65 of FIG. 1 hits the vertical carrier 32 and the optical axis of the second reflecting light barrier 66 simultaneously hits the vertical carrier 33 shown in FIG. 2, the cycle control device starts and instantaneously shuts-off the current rail 49. The drive motor 62 is thus stopped and the bobbin frame 27 remains in the position shown in FIG. 2. Contrary to the illustration shown in FIG. 2, the cross-wound bobbins are not yet in the bobbin frame 27. The cycle control device 25 then applies voltage to the current rail 51, so that the drive motors 42 and 42' are instantaneously activated, because the current rail 50 is still supplied with current. Since the drive motors 42 and 42' are stepping motors and because the current supply is always an alternating current with a certain frequency, the toothed racks 40 always move over a predetermined distance The timing is calculated in such a way that the racks 40 are maximally extended according to FIG. 4 and thereafter the cycle control device 25 disconnects the voltage from the current rails 50 and 51.

Figure 4:
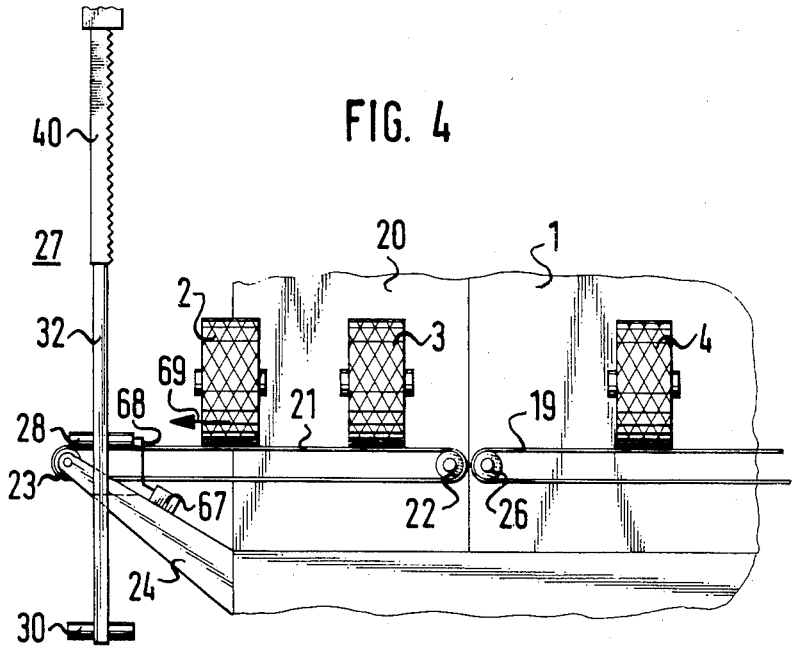
Figure 5:
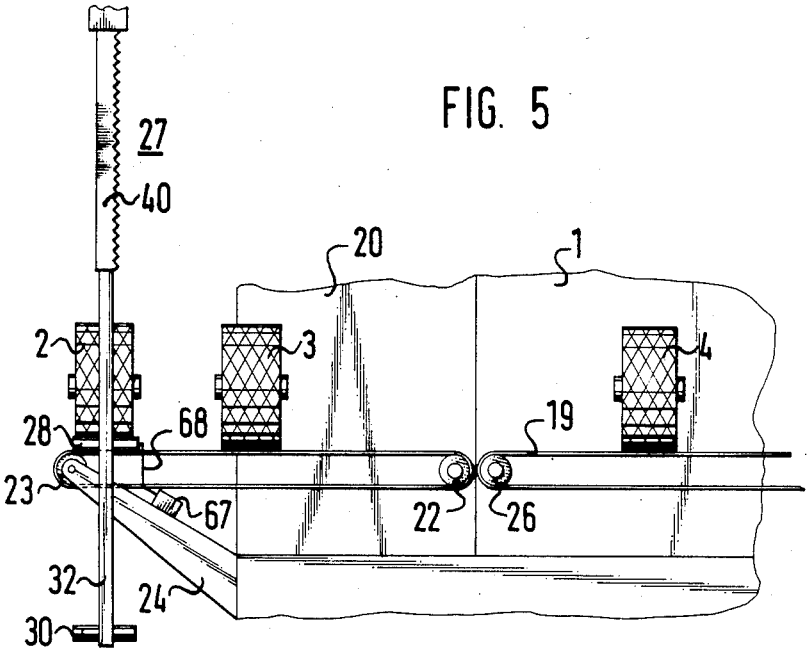

At this point, the carrying elements 28 are at the height of the upper edge of the conveyor 21, as shown in FIG. 4 and the same applies for the carrier elements 29. Starting with the position shown in FIG. 4, the cycle control device 25 subsequently turns on the motor of the belt roller 22, causing the cycling conveyor 21 to move in the direction 69, so that the first bobbin 2 lying on the conveyor 21 presses down the actuating arm 68 of the microswitch 67. The switching of the microswitch causes the cycle control device to switch the motor of the belt roller 22 to slow motion. At this slow motion speed, the cross-wound bobbin 2 continues its travel until it reaches the position shown in FIG. 5. At this moment the actuating arm 68 jumps back to its starting position and thereby causes the return of the microswitch 67 to is previous condition. Then the cycle control device 25 switches off the motor of belt roller 22.

Figure 6:
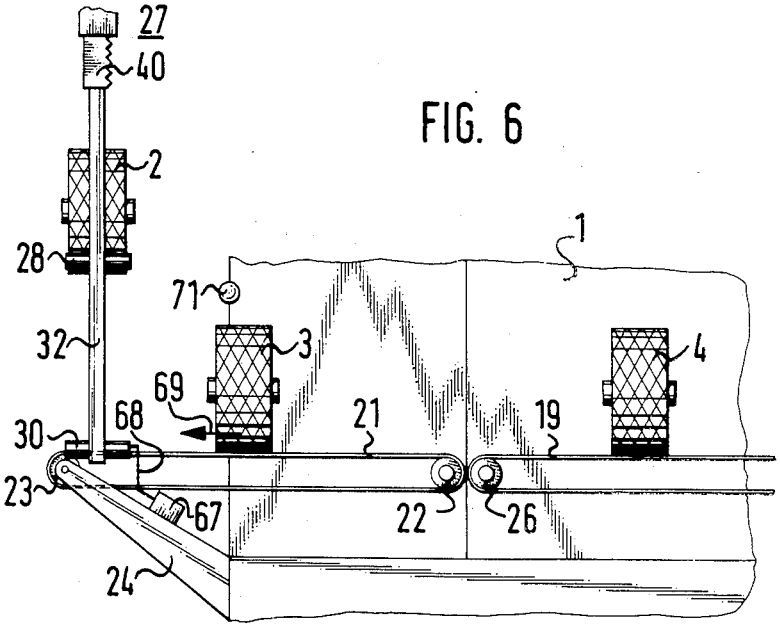

Due to the continuing action of the timer or time clock contained in the cycle control device 25, the polarity of the two current rails 50 and 51 is then reversed and voltage is then applied to the rails 50 and 51 again. The two drive motors 42 and 42' are thus started and operate in reverse, until their "on" time has elapsed, and the two racks 40 have not quite reached their Starting position as shown in FIG. 6. The carrying element 30 is then at the height of the upper edge of the cycling conveyor 21 as is the carrying element 31, which lies behind the element 30. The timer of the cycle control device 25 which continues to run, then turns on the motor of the belt roller 22 again, and then holds still and waits for a new start command. This new start command is again initiated by the microswitch 67 which reacts to the entry of the next bobbin 3 into the bobbin frame 27. At the moment that the actuator arm 68 is moved by the weight of the cross-wound bobbin 3, the timer starts again and switches the motor of the belt roller 22 to slow speed rotation. When the bobbin 3 is later properly positioned in the bobbin frame 27, the actuator arm 68 swings back which switches the microswitch, so that the cycle control device 25 shuts-off the motor of the belt roller 22 again. Then the cycle control device 25 turns on the two drive motors 42 and 42', until the gear racks 40 are again in their starting position, according to FIG. 1. Immediately thereafter the cycle control device 25 initiates a current cut-off from the current rails 50 and 51, then reverses their polarity, and then again supplies the current rails 49 and 50 with current so that the motor 62 can start again.

However, the bobbin frame 27 still cannot leave the textile machine 1, because the two reflecting light barriers 65 and 66 prevent this. The optical axes of the barriers simultaneously hit the vertical supports 33 and 34, thereby causing a new standstill of the bobbin frame 27. Before the above-described loading operation can be repeated at the mext following vertical row in the bobbin frame, the cycling conveyor 21 must again be loaded with two cross-wound bobbins.

Figure 7:
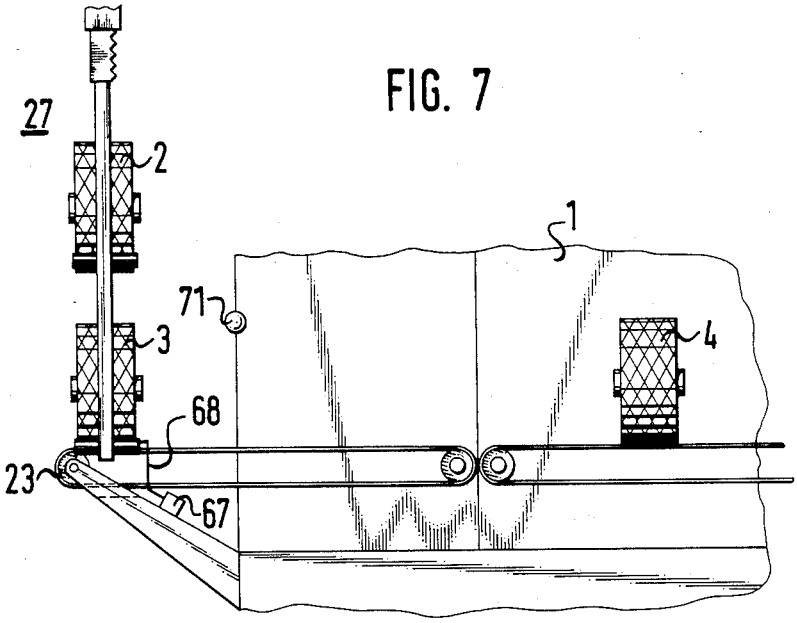

Triggered by the simultaneous signals of the reflecting light barriers 65 and 66, the cycle control device 25 initiates the simultaneous start of the motors of the belt rollers 22 and 26 and keeps them operating until an additional reflecting light barrier 71 which is disposed at the head end 20, indicates that the leading one of the two cross-wound bobbins, such as the bobbin 4 according to FIG. 7, has arrived at the light barrier 71, as shown in FIG. 1. Thereafter a new frame loading cycle begins.

In the above-described manner, the four vertical frame rows are filled in sequence one after the other, and it is then no longer possible for both optical axes of the two reflecting light barriers 65 and 66 to simultaneously hit the vertical carriers of the bobbin frame 27. After the last loading step the bobbin frame 27 subsequently moves on to an unloading station. At the latest at the unloading station, other current rails provide the current supply of the bobbin frame, and at the unloading station the bobbin frame can be unloaded in a manner similar to the filling operation. The unloading can be done either in the original filling direction or in the opposite direction. Due to the disposition of the reflecting light barriers 65 and 66 and the fact that the vertical carriers 32 to 36 have equal center spacings, the distance which the bobbin frame travels per cycle is equal to a center distance a between adjacent vertical rows of bobbins.

Figure 8:
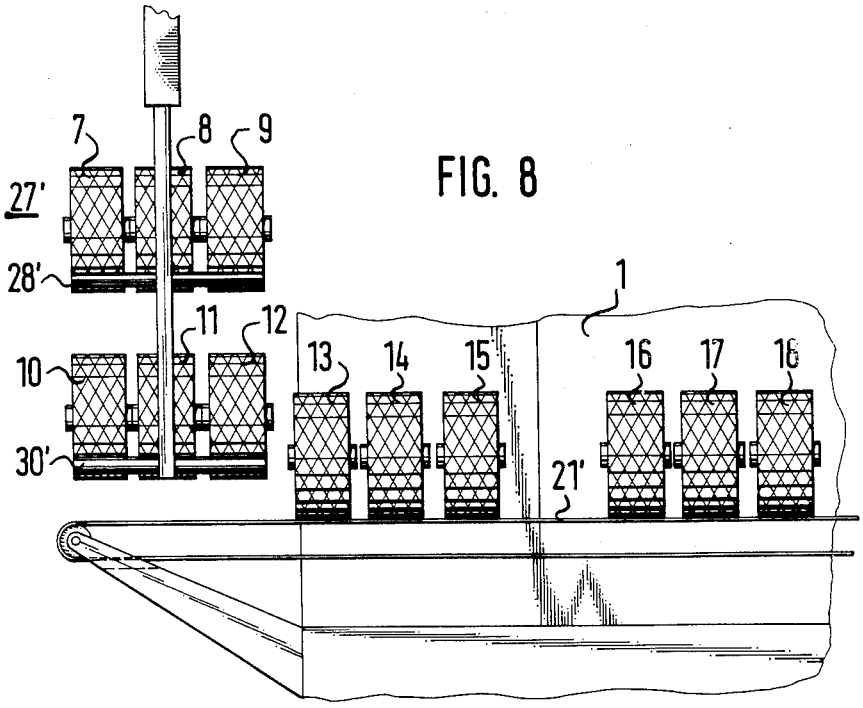
FIG. 8 is a fragmentary, front-elevational view of another embodiment of the invention.

Without describing any additional details, FIG. 8 shows an embodiment of a bobbin frame 27' that can simultaneously accept three bobbins 7, 8, 9, or 10, 11, 12, in each bobbin deposition location. For this purpose it is only necessary to provide elongated carrier elements 28', 30' and an elongated cycling conveyor 21'.

After the cross-wound bobbins 7 to 12 have been loaded according to FIG. 8, the bobbins 13 to 15 would be in line for placement into the upper row of the frame and the bobbins 16 to 18 would then be placed into the lower row of the bobbin frame.

After a corresponding elongation of the carrier elements, under certain circumstances even more than three bobbins can be placed into one storage position of the bobbin frame at the same time.

In the embodiment of the invention according to FIGS. 9 to 15, a different cycling conveyor 72 is provided at the head end 20 of the same textile machine 1 for producing cross-wound bobbins, for transporting bobbins from the winding machine 1'.

The cycle control device 25' is also slightly different. The bobbin frame 27'' has the same frame construction and the same carrying elements as the bobbin frame 27 according to FIG. 1 and FIG. 2. However, the lifting or elevating devices 38 and 39 are omitted, so that the bearing supports 52 and 53 are directly connected to the cross member 37. In this case, only two current rails 49 and 50 are required for supplying the drive motor 62 with power.

The cycling conveyor 72 in this case is also formed of an endless conveyor belt which is conducted over belt rollers 22' and 23'. The belt roller 22' has a motor which is functionally connected with the cycle control device 25'.

The cycling conveyor 72 can be raised to different heights or levels by two lifting or elevating devices 73 and 74. The lifting devices 73 and 74 are pneumatic cylinders, with piston rods 75, 76 that carry forks 77, 78. The belt roller 22' is rotatably supported in the fork 78 and the roller 23' is supported in the fork 77. Both lifting devices 73 and 74 are functionally connected to the cycle control device 25'. The lifting devices are always equally activated or deactivated pneumatically, so that the cycling conveyor 72 is approximately horizontal in every position.

Figure 9:
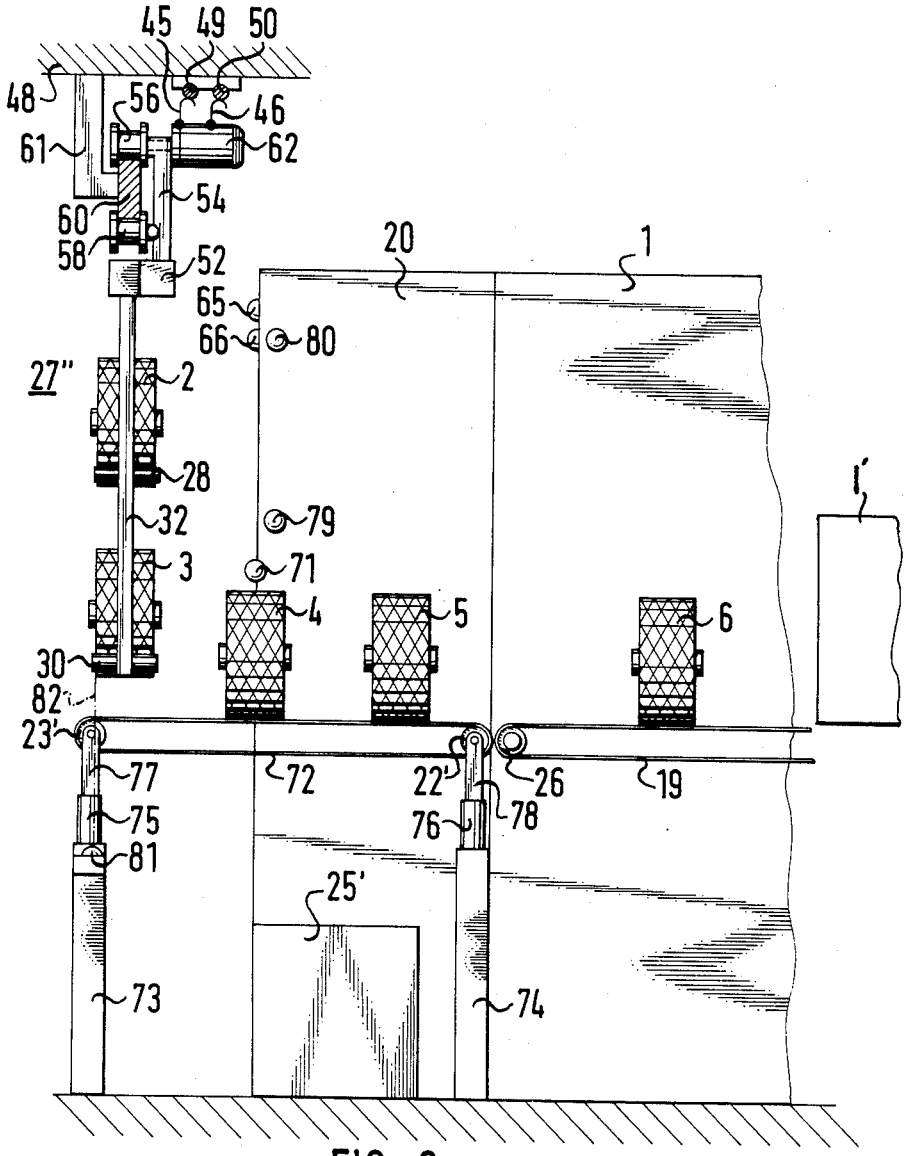
FIG. 9 is a fragmentary, front-elevational view of a third embodiment of the textile machine according to the invention.

The cycling conveyor 72 can be moved from its basic position according to FIG. 9 to heights or levels which permit the loading of bobbins into the bobbin frame 27''. The change of the level or height is controlled by two reflecting light barriers or gates 79 and 80, which are functionally connected to the cycle control device 25'. An additional reflecting light barrier 81 is located at the lifting device 73. The optical axis 82 of the barrier 81 is directed vertically upward.

In the device according to FIGS. 9 to 15, parts which are identical with corresponding parts of the device according to FIGS. 1 to 7 are designated by the same reference numerals.

The device of the third embodiment according to FIGS. 9 to 15, functions as follows:

When the reflecting light barriers 65 and 66 are in line with the vertical carriers 32 and 33 of the entering bobbin frame 27'', the cycle control device removes the current from the current rail 49. Subsequently, the drive motor 62 stops and the bobbin frame 27'' remains in the position shown in FIG. 10 with respect to the cycling conveyor 72. At the same time, the two lifting devices 73 and 74 are pneumatically activated, so that the conveyor 72 moves upward in the direction of the arrow 83 from the position shown in FIG. 11, until the horizontal optical axis of the reflecting light barrier 80 hits or is aligned with the bobbin 2 which lies on the cycling conveyor 72.

Figure 12:
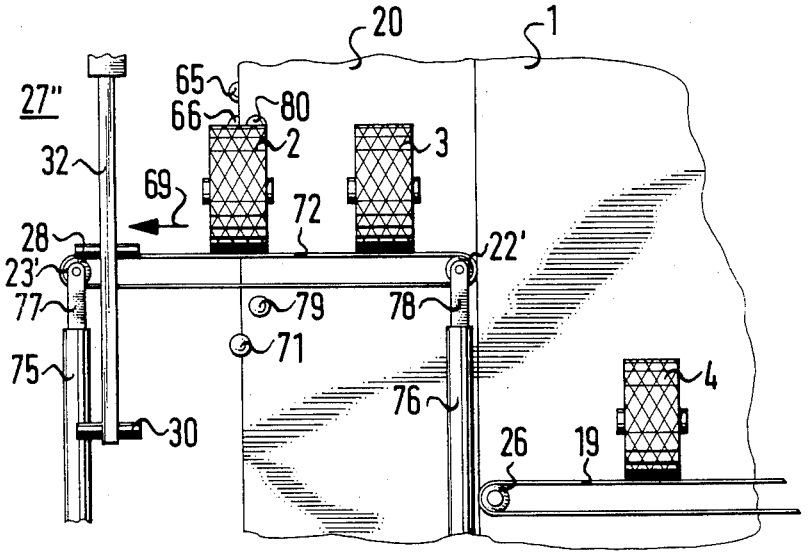

The signal from the reflecting light gate 80 causes the cycle control device 25' to stop the activation of the lifting devices 73 and 74 and to turn on the motor of the belt roller 22'. The position of the device at this moment is shown in FIG. 12.

Figure 13:
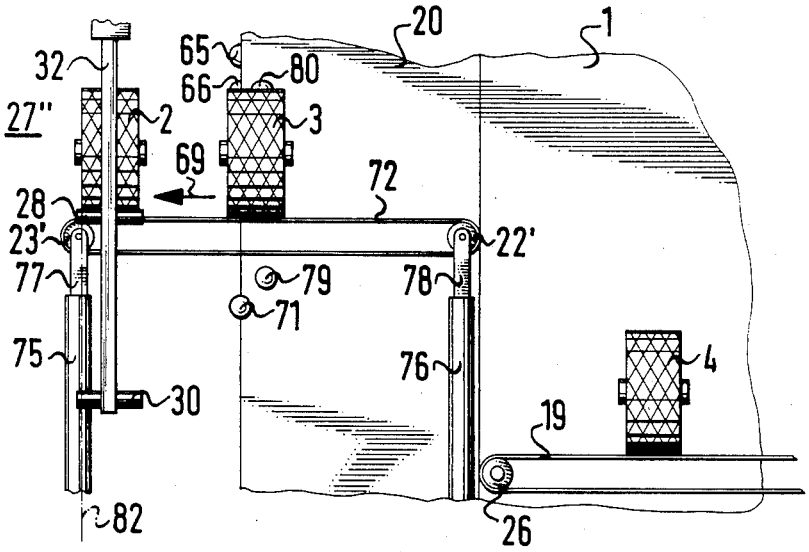

The cycling conveyor 72 then moves in the direction 69, until the foremost bobbin 2 lying on the conveyor 72 according to FIG. 13, has reached the optical axis 82 of the reflecting light barrier 81. At this moment the reflecting light barrier 81 is triggered and turns off the motor of the belt roller 22' by means of the cycle control device 25'. This stops the conveyor 72 immediately. At the same time, the two lifting devices 73 and 74 are pneumatically deactivated, until they are in the position shown in FIG. 9. After this has occurred, the reflecting light barrier 79 is activated and the two lifting devices 73 and 74 are again supplied with air, so that the cycling conveyor 72 is again raised in the direction of the arrow 83, until the bobbin 3 which still lies on the conveyor 72 according to FIG. 14, has reached the horizontal optical axis of the reflecting light barrier 79. Due to the signal of the reflecting light barrier 79, the cycle control device 25' immediately cuts off the air supply to the lifting devices 73 and 74 and again sets the motor of the belt roller 22' in motion.

Figure 14:
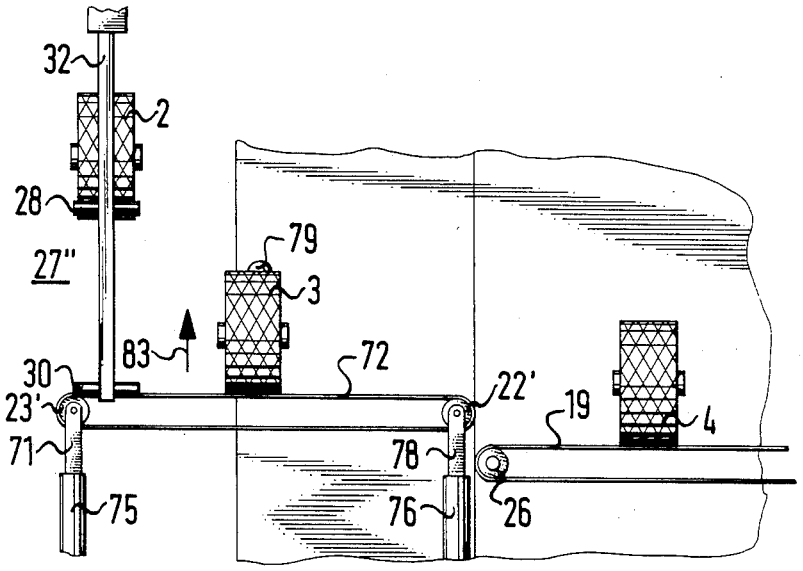
Figure 15:
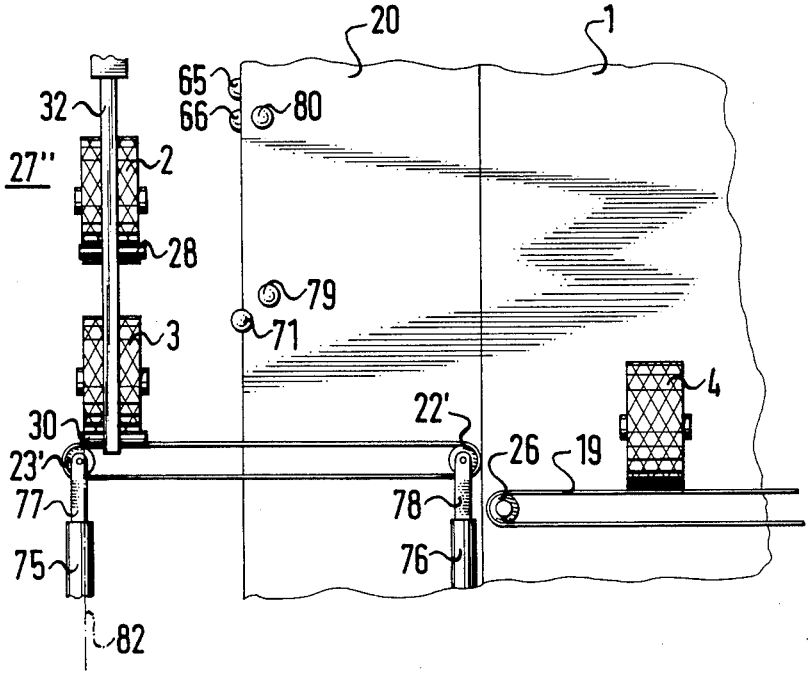

From the position shown in FIG. 14, the cross-wound bobbin 3 then reaches the optical axis 82 of the reflecting light barrier 81. Due to the signal of the reflecting light barrier 81, the cycle control device 25' again deactivates the two lifting devices 73 and 74, which thereafter return to their starting position shown in FIG. 9. At the same time, the cycle control device 25' causes voltage to be applied to the current rail 49 again. Furthermore, the cycle control device 25' simultaneously causes the motors of the belt rollers 22' and 26 to be turned on. These two belt roller motors continue to run until the next bobbin in line, which is the bobbin 4, has reached the optical axis of the reflecting light barrier 71. Then the reflecting light barrier 71 causes the cycle control device 25' to turn off the motors of the belt rollers 22' and 26. This condition of the cycle is shown in FIG. 9. Behind the bobbin 4, the next bobbin 5 has already reached the conveyor 72. An additional bobbin 6 has been transported along on the conveyor 19.

The cross-wound bobbin 5 is positioned at the required distance behind the bobbin 4. However, if the belt conveyor 19 is not able to supply a bobbin at the proper cycling distance, the reflecting light barrier 71 can be utilized to determine if a bobbin is located on the cycling conveyor 72 in the required position before each frame loading operation and if this is not the case, it can be utilized to start the motors of the belt roller 22' and 26, until a cross-wound bobbin reaches the optical axis of the reflecting light barrier 71.

Figure 10:
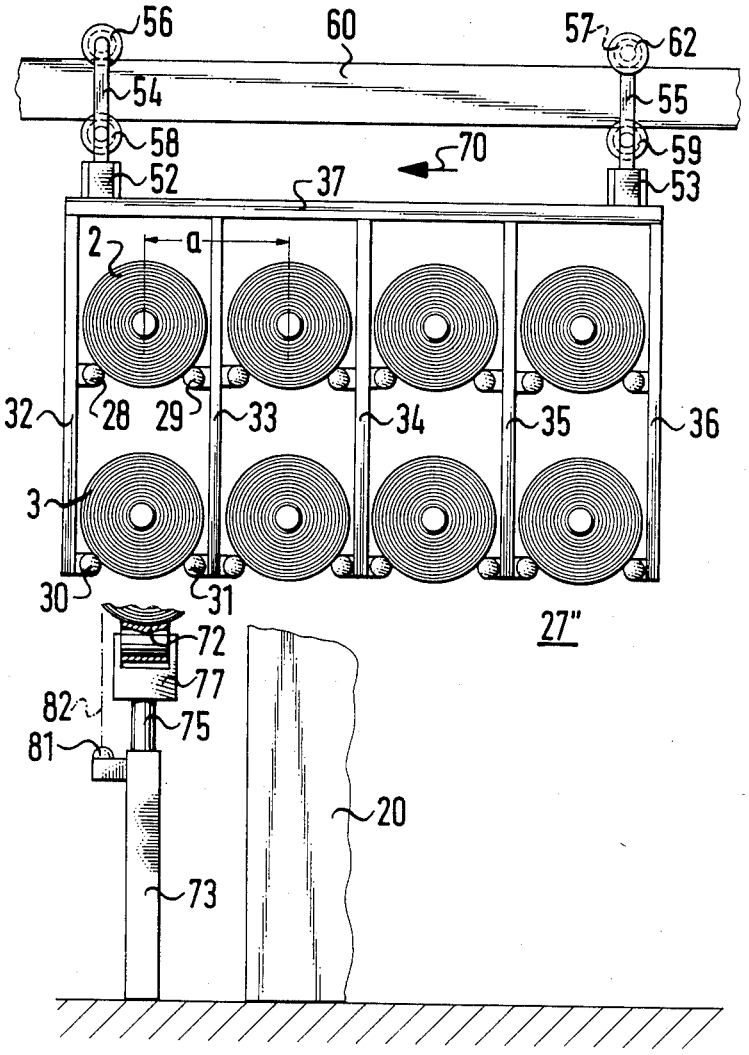
FIG. 10 is a side-elevational view of the bobbin frame of the textile machine shown in FIG. 9.
Figure 11:
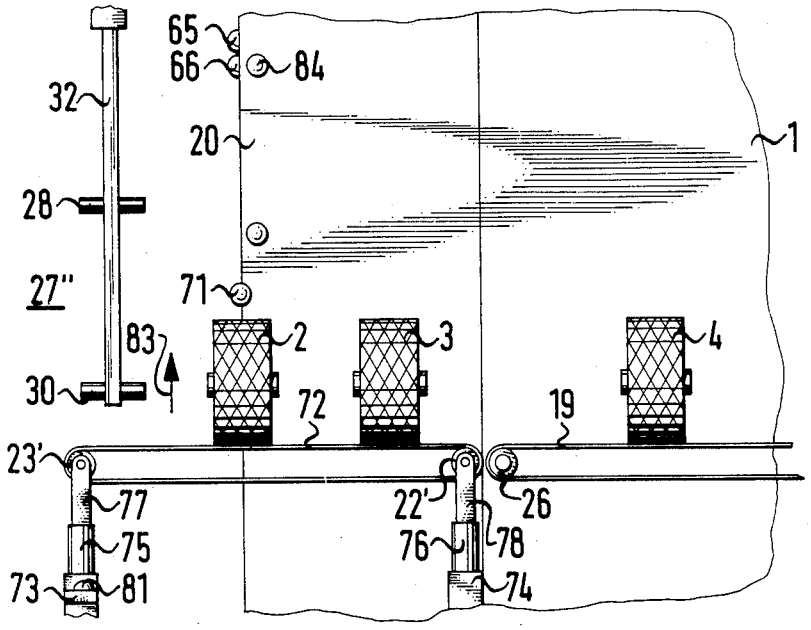
FIGS. 11 to 15 are front-elevational views of a portion of FIG. 9 shown in various operating phases.

By supplying the current rail 49 with voltage again, the bobbin frame 27'' is caused to move on in the direction 70 shown in FIG. 10, until the optical axes of the reflecting light barriers 65 and 66 simultaneously hit the vertical carriers 33 and 34. As in the first embodiment, the bobbin frame 27'' stops again and the above-described frame loading steps are repeated for the second vertical row of the bobbin frame. These loading operations are still repeated twice, until the whole bobbin frame 27'' is filled with bobbins. Then the bobbin frame 27'' finally moves on, in the same way as in the first embodiment.

I claim:

1. Textile machine for producing cross-wound bobbins, comprising a winding machine, a head end of the textile machine, a cycling conveyor disposed at said head end for transporting cross-wound bobbins from said winding machine in a given cycling direction, at least one bobbin frame movable relative to said cycling conveyor between loading positions and a transport position in which the entire width of said bobbin frame as seen in said given cycling direction is disposed above said cycling conveyor, said cycling conveyor fully loading said bobbin frame with cross-wound bobbins from said cycling conveyor from one side of said bobbin frame, means for moving said bobbin frame across said given cycling direction, said bobbin frame including vertical carriers and pairs of mutually spaced apart carrier elements disposed on said vertical carriers for supporting at least one row of cross-wound bobbins at least at one level, said carrier elements of each pair being disposed at substantially the same height above said cycling conveyor and being mutually spaced apart by a given distance, said cycling conveyor being narrower than said given distance, said bobbin frame having vertical openings formed therein from below permitting passage of said cycling conveyor between said vertical carriers, and at least one lifting device for adjusting the relative height of said bobbin frame and said cycling conveyor.

2. Textile machine for producing cross-wound bobbins according to claim 1, wherein said cycling conveyor is substantially horizontal and said carrier elements are substantially horizontal.

3. Textile machine for producing cross-wound bobbins according to claim 1, wherein said cycling conveyor is inclined relative to the horizontal, and said carrier elements are forwardly inclined relative to the horizontal.

4. Textile machine for producing cross-wound bobbins according to claim 1, including means for operating said lifting device in a controlled cycle.

5. Textile machine for producing cross-wound bobbins according to claim 1, wherein said lifting device is connected to said cycling conveyor.

6. Textile machine for producing cross-wound bobbins according to claim 1, wherein said lifting device is connected to said bobbin frame.

7. Textile machine for producing cross-wound bobbins according to claim 1, including a common cycle control device connected to said bobbin frame, said cycling conveyor and said lifting device.

8. Textile machine for producing cross-wound bobbins according to claim 1, wherein said carrier elements support a plurality of rows of bobbins at respective levels including a top level, and said bobbin frame is formed of a frame structure including said vertical carriers carrying said carrier elements, and at least one cross member interconnecting said vertical carriers above said top level.

9. Textile machine for producing cross-wound bobbins according to claim 1, wherein said bobbin frame is a hanging carriage.

10. Textile machine for producing cross-wound bobbins according to claim 8, wherein said bobbin frame moving means includes a drive mechanism, and said lifting device is disposed between said drive mechanism and said frame structure.

11. Textile machine for producing cross-wound bobbins according to claim 1, wherein said lifting device is disposed below said cycling conveyor.

12. Textile machine for producing cross-wound bobbins according to claim 1, wherein the bobbins on said carrier elements are disposed in vertical rows spaced apart by a given spacing, and said drive mechanism moves said bobbin frame by a cycling travel distance substantially equal to said given spacing.

13. Textile machine for producing cross-wound bobbins, comprising a winding machine, a head end of the textile machine, a cycling conveyor disposed at said head end for transporting cross-wound bobbins from said winding machine in a given cycling direction, at least one bobbin frame movable relative to said cycling conveyor between loading positions and a transport position in which the entire width of said bobbin frame as seen in said given cycling direction is disposed above said cycling conveyor, said cycling conveyor fully loading said bobbin frame with cross-wound bobbins from said cycling conveyor from one side of said bobbin frame, means for moving said bobbin frame across said given cycling direction, said bobbin frame including vertical carriers and at least one pair of mutually spaced apart carrier elements disposed on said vertical carriers for supporting at least one row of cross-wound bobbins at least at one level, said carrier elements of each pair being disposed at substantially the same height above said cycling conveyor and being mutually spaced apart by a given distance, said cycling conveyor being narrower than said given distance, said bobbin frame having vertical openings formed therein from below permitting passage of said cycling conveyor between said vertical carriers, and at least one lifting device for adjusting the relative height of said bobbin frame and said cycling conveyor.

* * * * *